United States Patent [19]

Marquardt

[11] 3,999,024

[45] Dec. 21, 1976

[54] ELECTRICAL SWITCH CONSTRUCTION

[75] Inventor: Ewald Marquardt, Rietheim, Germany

[73] Assignee: J. and J. Marquardt, Rietheim, Germany

[22] Filed: Mar. 17, 1975

[21] Appl. No.: 558,860

[30] Foreign Application Priority Data

Mar. 16, 1974 Germany ..... 2412812

[52] U.S. Cl. ..... 200/68; 200/6 B; 200/67 G

[51] Int. Cl.[2] ..... H01H 21/40

[58] Field of Search ..... 200/67 G, 68, 153 LM, 200/6 B, 6 BB, 6 C, 76

[56] References Cited

UNITED STATES PATENTS

| | | | |
|---|---|---|---|
| 2,027,538 | 1/1936 | Krieger | 200/67 G |
| 2,469,336 | 5/1949 | Kohl | 200/67 G |
| 2,506,196 | 5/1950 | Bourne | 200/68 |
| 2,795,667 | 6/1957 | Schwerke | 200/67 G |
| 3,646,291 | 2/1972 | Bienwald | 200/67 G |
| 3,735,060 | 5/1973 | Kawai | 200/6 R |
| 3,746,359 | 7/1973 | Lewis | 200/67 G |

FOREIGN PATENTS OR APPLICATIONS

| | | | |
|---|---|---|---|
| 1,557,136 | 1/1969 | France | 200/67 G |
| 593,175 | 5/1959 | Italy | 200/67 G |

*Primary Examiner*—David Smith, Jr.
*Attorney, Agent, or Firm*—McGlew and Tuttle

[57] ABSTRACT

An electrical switch comprises at least one fixed contact which is engageable by a movable contact contained on a first arm portion of a movable contact member which also has a second arm portion which is disposed at an angle to the first arm portion. An actuating member is engageable with the movable contact member and is displaceable over the second arm portion to engage the first arm portion and to pivot it in a direction to move the movable contact to engage the fixed contact. First spring means bias the actuating member in a direction toward engagement with the movable contact member and during the movement of the movable contact member the second arm portion is moved in a direction opposite to the direction of the first arm portion to force the first spring means to increase the biasing force thereof. In the closed position of the contact the first spring means may in one embodiment be increased in biasing force and in another embodiment be maintained at the same biasing force as its initial position. A second spring means acts in a direction to return the actuating member to a non-actuated position.

19 Claims, 4 Drawing Figures

FIG. 1
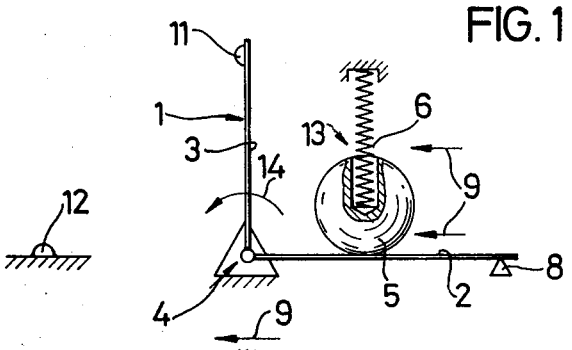
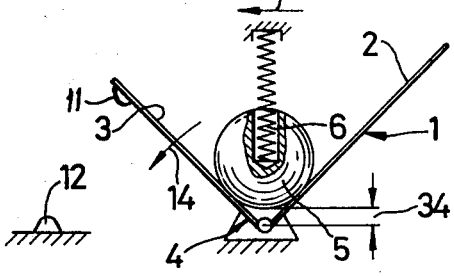
FIG. 2
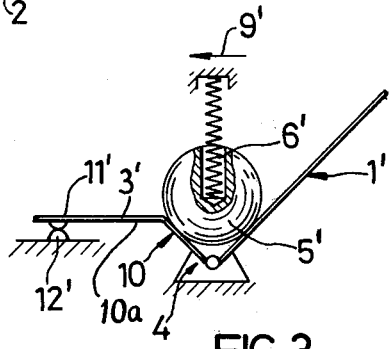
FIG. 3
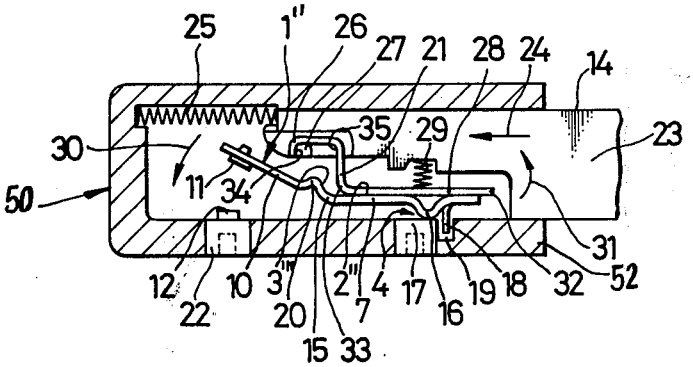
FIG. 4

ELECTRICAL SWITCH CONSTRUCTION

BACKGROUND OF THE INVENTION

1. Field of the Invention

This invention relates in general to the construction of switches and in particular to a new and useful electrical switch which includes a movable contact contained on one arm portion of a movable contact member having another arm portion at an angle to the first arm portion and which includes an actuating member which is engageable with the movable contact member to cause a pivoting of the first arm member with the movable contact to engage the fixed contact and a corresponding movement of the second arm member in an opposite direction to increase a biasing force on a spring biasing means acting on the actuating member.

2. Description of the Prior Art

The present invention is particularly directed to an electrical switch which has an actuating member which is movable through a travel distance prior to the switching operation or is designed with an idle approach and/or an after travel of the actuating member. The invention is an improvement over the known switches of such construction in that it is simple in design and concept and economical to manufacture.

SUMMARY OF THE INVENTION

In the switch constructed in accordance with the invention, the contact arm is mounted so as to be tiltable or swingable and designed with two arm portions defining engaging surfaces for the actuating member which extend at an angle to each other, one in a first switching direction and the other in a second switching direction, but both within the range of displacement of the actuating member. This switch makes it possible to move the actuating member through a certain travel distance, both in advance of and after the switching proper. Consequently, the switch is relatively insensitive to a perhaps too extensive displacement of the actuating member and, in addition, both during the approach and the after-travel, the actuating member may serve for the performance of still other operations. During the approach travel, the actuating member is moved along the one of the engaging surfaces but does not necessarily engage the same prior to the switching operation proper. After the switching, a further motion along the other engaging surface is possible, but no permanent engagement therewith is necessary and a pressing down in the switching end position is sufficient. Due to the tilting or swinging, the respective engagement surface previously traversed or passed at a distance comes, after the switching in the one or the other direction, into the motion zone of the actuating member subsequently moved in the opposite direction so that upon reversal of the actuating member the contact arm also executes a respective opposite swinging or tilting motion.

In a particularly preferred embodiment of the invention, the contact arm is designed in the form of an angle piece so that it can be made, for example, of a flat metal strip. According to a development of the invention, the bearing support of the contact arm may be provided in the zone of the angle corner. For example, the angle corner itself may be used as a sort of a knife-edge support.

According to another feature of the invention, the actuating member comprises a spring-loaded ball or is designed with a crowned or convex portion, and the ball of the convex portion of the actuating member is associated or associatable with the two engaging surfaces of the contact arm. In the absence of particular measures, due to the action of the spring, the ball or convex portion of the actuating member is permanently applied against the one or the other engaging surface or angle leg, respectively. During the switching operation proper, both are contacted simultaneously.

In a further variant of the invention, the actuating member is displaceable parallel to one of the two engaging surfaces and, preferably, applies against the same continuously, at least up to the switching operation proper. As the angle-shaped contact arm provided with the engaging surfaces extending at an angle to each other starts to turn, the actuating member, irrespective of whether or not, at the beginning of the rotary motion, it is still applied against the contact arm, is lifted against the action of its loading spring so that the loading spring is stressed or, if already biased, more stressed. The result is that, upon reaching its unstable swing position, the contact arm jumps into its closure position whereby, depending on the design and the angle of rotation, the additional tensional force of the spring may be relieved again, completely or only partly. In the last-mentioned case, a zero exceeding contact pressure is obtained already at the instant of the contact closure.

It is also very advantageous to provide the line of action of the loading spring in a transverse, particularly perpendicular, direction to the direction of displacement of the actuating member and to make the spring displaceable along with the actuating member. Due to this latter measure, the full force of the spring is effective along the entire travel wherefore, even in a switch designed with an after-travel of the actuating member, the full contact pressure of the movable contact is maintained. The condition in this case is, however, that the displacement takes place in the longitudinal direction of the respective contacted angle arm or engaging surface.

In a displacement along a straight path during the entire actuation, a right angle between the contact arms or engaging surfaces and a tilting of the contact arm through 90° is of particular importance. At the end of the approach travel or at the start of the rotary motion of the contact arm, the spring-loaded actuating member (for example, a ball) is lifted whereby the loading spring is stressed or more stressed. The degree of the additional stressing of the spring depends on the angle between the contact arm legs or engagement surfaces and on the curvature of the contacting surface of the actuating member, thus, for example, on the diameter of the ball. Assuming that at the start of the swinging motion of the contact arm, the actuating member has already been biased, this means that this bias increases continuously until the contact arm reaches its unstable tilting position and decreases again, also continuously, during the subsequent rotary motion. In any case, however, the advantageous result is obtained that at the instant of contact closing, the contact force is already greater than zero. At the same time, this increase in the spring tension provides for an accelerated and, thereby, impact-like contact closure. Inversely, an accelerated return motion of the contact arm is thereby also obtained. A further and quite particularly important aspect of this embodiment is to be seen in that the increase of the spring pressure up to the moment the unstable tilting position of the contact arm is reached, as well as its sudden dropping to the initial value, can be clearly perceived by touch, on the actuating member or on the switch actuator if directly touched with the finger or hand, so that the switch is given a distinctly perceptible switching point. This is important particularly for the application of the invention to electrically operated hand tools switchable by means of a pushbutton because there, during work, in the absence of a distinctly perceptible switch point, the pushbutton may frequently be kept jumping between the on and off position, with the result of a very rapid burning of the contacts. This does not apply to pushbuttons equipped with a locking mechanism.

In order to be able to hold the non-contacting leg of the contact arm resiliently down while the actuating member covers the entire travel distance, it is advantageously provided to support this non-contacting leg of the contact arm, which, in the initial position, rests against the actuating member, by a stop located at a distance from the swing bearing of the contact arm.

A particularly important feature of the invention is that at least one of the two legs of the contact arm is connected to a control circuit or device and, preferably, is longer than the other leg. This longer leg is advantageously designed, for example, as a sliding resistance which is tapped off during the displacement of the actuating member so that prior to the switching operation proper, a continuous and if desired also a stepped control of a certain operation may be effected. However, in such a case, the control devices and the switches remain electrically separate units.

In accordance with a further development of the invention, the angle leg of the contact arm carrying the movable contact is bent or angled outwardly at a location spaced from the swing axis so that, with the contacts closed, the bent portion extends preferably approximately parallel to the direction of displacement of the actuating member. With a position of the non-contacting leg of the contact arm also parallel to the direction of displacement, a constant spring tension can be obtained during the displacement of the spring-loaded actuating member up to the start of the switching phase. At the instant of switching, the ball, or the actuating member provided with a convex portion, is lifted against the action of the spring whereby the spring is stressed. In the switched-on position, in cases where the contact carrying leg of the contact arm does not extend also parallel to the direction of displacement of the actuating member, as the actuating member continues to move, the spring force continues to increase. If the spring is compressed up to its blocking configuration, the actuating member cannot move further. Such a blocking by the spring is now prevented by the mentioned feature which, in addition, depending on the chosen longitudinal proportions, permits a further displacement of the actuating member even with a blocked spring. The condition in such a case is, however, that in the on-position, the free angled portion of the contact carrying leg of the contact arm extends in parallel or, perhaps, also in a slightly diverging direction to the direction of displacement of the actuating member. Therefore, a further development of the invention provides that in the on position of the switch, the actuating member is displaceable along, or partly above, the bent or angled portion of the contact arm leg carrying the movable contact. With a spring-loaded actuating member, however, a displacement partly above the contact arm leg is not practicable.

According to another variant of the invention, the actuating member is displaceable, in the switch-on direction, against the action of a reset spring. As far as an approach travel is provided, the force of the reset spring increases continuously up to the start of the rotary motion of the contact arm. This linear increase continues up to the closure of the contacts and, if an after travel is provided, also during this subsequent idle motion of the actuating member. This linearly increasing characteristic, however, is superposed by the increasing and decreasing force exerted by the compressed loading spring of the actuating member so that in this variant again, a distinctly perceptible pressure point becomes manifest through the actuating member or a push-button or the like. This pressure point is perceptible, of course, also during the resetting, this time with a minus sign. Thus, in a design without a reset spring, the pressure point is perceptible with the same distinctness, only, considered through the travel distance, the values of the forces are negative. In the design with a reset spring, the resetting can be perceived too. However, in this case, the value of the total force does not pass into the negative because the characteristic of the reset spring is sufficiently steep and the negative "force impact" caused by the loading spring is not too strong. In this manner, an optimum actuation characteristic is obtained for a pushbutton switch, with the contact force at each point greater than zero.

It is easily possible and also advantageous to provide the swing bearing in the form of a bulge or an extension of the non-contacting leg of the contact arm. Another advantage is obtained, from the point of view of the manufacturing technology and expenses, if the swing bearing is supported on an electrically conducting switch part forming or connected to a contact terminal or the like and if the contact arm itself is made of an electrically conducting material. Particularly with the first-named alternative, the mounting of the contact arm establishes automatically an electrically conductive connection from this terminal up to the mobile contact.

Should the swing bearing be not sufficiently secured against displacement, particularly, if the bearing portion, for example, the bearing edge or the like, is supported on a plane surface extending parallel to the direction of displacement of the actuating member, an appropriate locking must be provided. Therefore, according to a further variant of the invention, a security element preventing the displacement of the contact arm is provided between the free end of the non-contacting leg of the contact arm and the swing bearing of the contact arm, and comprising, preferably, a tongue or the like connected to the contact arm and engaging into a slot of the switch. The tongue may be, for example, punched and bent out of the contact arm. The slot must be sufficiently wide to permit the swinging motion of the tongue during the switching phase of the switch.

According to another preferred embodiment of the invention, the actuating member is mounted on the pushbutton for displacement, approximately in the direction of actuation of the pushbutton, between two stops. In this manner, an automatic switching on is obtained upon exceeding of the unstable position, even in cases where the actuating member is not displaced further. This applies both to the forward and to the back switching. This means that a perceptible pressure point appears in the case of the shown example, i.e., at the closing of the contacts, while a pressure point is absent at the resetting of the displaced parts.

Accordingly it is an object of the invention to provide an electrical switch which comprises at least one fixed contact and a movable contact which is carried on a first arm portion of a movable contact member which has a second arm portion disposed at an angle to the first arm portion over which an actuating member is movable into engagement with the first arm portion to move the movable contact into engagement with the fixed contact and to cause the second arm portion to move against spring biasing force to increase the force during movement and wherein this biasing force may be either increased after the contact is made or maintained at an initial biasing value and in an arrangement wherein the actuating member may move further even after contact is made.

A further object of the invention is to provide an electrical switch which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

BRIEF DESCRIPTION OF THE DRAWINGS

In the drawings:

FIG. 1 is a diagrammatical view of a switch constructed in accordance with the invention shown in an initial position;

FIG. 2 is a view of the switch shown in FIG. 1 in an advanced position from that shown in FIG. 1 and in an unstable position immediately before switching;

FIG. 3 diagrammatical view similar to FIG. 1 of another embodiment of the invention shown in an actuated position; and FIG. 4 is a partial axial sectional view of another embodiment of a switch.

DESCRIPTION OF THE PREFERRED EMBODIMENTS

Referring to the drawings in particular the invention embodied therein in the embodiments of FIGS. 1 and 2 comprises an electrical switch which includes a movable contact member generally designated 1 having a first arm portion 3 containing a movable contact 11 which moves with this arm portion to engage a fixed contact 12. Movable contact 1 also includes a second arm portion 2 which has a surface engageable with an actuator member generally designated 13 which in the embodiment illustrated is in the form of a ball member 5. The movable contact member 1 in the embodiment illustrated is mounted on a fixed bearing 4 for pivotal motion in the direction of the arrow 14. The actuating member ball 5 is provided with a recess to accommodate a spring 6 which forms first biasing means acting on the movable contact 1 and specifically on the second arm portion 2 thereof.

In the initial position of the switch shown in FIG. 1 the actuating member 5 is supported on the arm 2 at a spaced location from the bearing 4 and the free end of this arm rests on a support for example the support 8.

To actuate the spring the actuating member 13 is displaced for example in an actuating direction indicated by the arrows 9 along the second arm 2 until the actuating member 5 finally abuts on first arm portion 3 which carries the movable contact 11 and moves it in the direction of the arrow 14 until the movable contact 11 engages the fixed contact 12. During this movement the actuating member 5 moves through the unstable condition shown in FIG. 2 in which the actuating member 5 is raised by a distance 34 above its previous position so that the biasing force on the spring 6 is increased. Once the actuating member 5 moves beyond this position the ball may drop downwardly again to the height of the pivot 4 and maintain the contact in engagement with a uniform biasing force supplied by the spring 6. Contact member 9 may continue to move beyond a position in which the contacts 11 and 12 are interengaged.

The degree of compression of the spring 6 in the unstable condition shown in FIG. 2 depends upon the angle between the arm portions 3 and 2 as well as upon the diameter of the ball actuating member 5. In the example shown in the on position biasing force produced by the first spring means 6 is relieved somewhat after the unstable position shown in FIG. 2 is passed.

In principle an increased spring pressure is desirable for contact closure engagement and therefore in the embodiment of the device shown in FIG. 3 in which similar parts are designated with similar numbers but with primes, the arm portion 3′ is provided with an angled part so that after the unstable condition of previous FIG. 2 is passed the actuator ball may climb an inclined section generally designated 10 of the first arm portion 3′ and in so doing increase the biasing force of the first spring means 6′. The first arm portion 3′ may also have a portion 10*a* along which the actuator ball member 5′ may move and in which the biasing force of the second spring means 6′ is not increased beyond that in which it is increased by the movement over the section 10. The surface portion 10*a* may be used to permit a movement of after travel which is essential primarily in mechanical switching operations.

In accordance with a particular embodiment of the invention the two leg portions 2 and 3 which in the embodiments of FIGS. 1 and 2 and 3 are shown of equal length may be of unequal length if desired. The longer leg may be used as a part of a control circuit or device. For example, a sliding resistance may be provided on the longer leg and different sections of this leg may be tapped off by the actuating member in accordance with the amount of its displacement along this leg. The tapping may also be effected in a non-contacting manner and/or in steps. In the last case a plurality of auxiliary switches to be switched contactlessly are located along the leg and they are individually switched on and off by means of the actuating member. It is not necessary for the actuating member to apply against the non-contacting leg of the contacting arm but the contacting arm may be interconnected with a further spring catch mechanism (not shown) for interengaging the contact member with the arm.

In the embodiment shown in FIG. 4 there is provided a switch generally designated 1″ arranged within a housing generally designated 50 and the switch may be designed as a single pole or a multi pole switch and may even comprise two or more such switch systems one arranged after the other. The construction includes a movable contact member with a first arm portion 3‴ arranged at an angle to a second arm portion 2'' as in the other embodiment. In this embodiment the arm portions 3''' and 2'' are arranged at an angle of more than 90° in respect to each other. A knee formation 15 is formed adjacent the juncture of the two arms in an area immediately adjacent an upwardly formed bulge 20. A downwardly projecting bulge 16 on the second arm portion 2'' provides a supporting surface for supporting this arm portion on a connection terminal 17. The construction also includes a depending tongue formation 18 which is punched out of the second arm portion 2'' and is bent downwardly to engage into a slot 19 which is provided in a wall 52 of the switch housing. The slot 19 is partly formed by the right hand wall portion of the connection terminal 17.

The right hand flank of the bulge forms an abutting surface for the actuating member generally designated 21 and engages behind the bulge 20 at a knee portion 15 during the movement of the actuator member in the form of a pushbutton 23 in the direction of the arrow 24. The actuating member 21 is pivotally mounted on the pushbutton 23 and it is movable in the direction of the arrow 24 against the action of at least one second spring means such as a reset spring 25. Actuating member 21 comprises a metal strip which has one end portion which is bent into a substantially U-shaped configuration in order to form a hook-shaped bearing portion which engages over a supporting stud 27 on the pushbutton 23. Leg 28 of the actuating member 21 extends parallel to the non-contacting leg 7 of the contact arm and flatly applies against this arm under the action of a compression spring 29. The compression spring 29 comprises the first spring means which acts on the movable contact member. Since the leg 28 extends in the longitudinal direction beyond the bearing 4 a stable position of the contact arm 1'' is obtained.

In the shown embodiment of FIG. 4 a certain approach travel is provided that is the contacting member 21 first moves along a short displacement path in the direction of arrow 24 to abut against the right hand flank of bulge 20. As the button 23 is pushed further contact arm 1'' is swung in the direction of the arrow 30 while the actuating member 21 executes a swinging motion in the direction of the arrow 31 about stud 27 and against the action of the spring 29. Upon a still further pushing of the button 23 the leg 28 moves over the crest of the bulge 20. With the portion of the contact carrying leg of the contact arm extending to the left of the bulge 20, the actuating member 21 does not come into contact. Spring 29 applies against the top of the bulge 20 in its engaged position and thus with the contacts closed.

The pushbutton 23 can be locked in the usual manner. Upon unlocking the pushbutton all of the movable parts will return automatically to their initial positions. In the course of this motion the back swinging of the contact arm may be initiated either by the free end 32 of the leg 28 abutting against the opposite engaging surface 2'' or by the fact that after having passed over the bulge 20 the leg 28 of the actuating member impinged abruptly upon the entire length of the second arm 2'' of the contact member. The crowned or convex portion of the actuating member comprises a portion 33.

The hook-shaped end portion of the actuating member 21 used as the mounting element is designed so that it can be displaced along the pushbutton 23 in the direction of the arrow 24 as well as in an opposite direction. Supporting stud 27 is adapted to apply against either the one end surface 34 or the other end surface 35 of the hook-shaped portion. Upon actuating pushbutton 23 in the direction of the arrow 24 the stud 27 applies against inner surface 34 and during an opposite motion of the pushbutton, the stud 27 applies against the inner surface 35. In this case after having reached the unstable position of contact arm 1, the actuating member can continue to move further against the direction of the arrow 24 and thereby effect the switching even if the pushbutton 23 is stopped. While switching on thus closing the contacts the pressure point is again distinctly perceptible but during the resetting as a rule it does not appear.

While specific embodiments of the invention have been shown and described in detail to illustrate the application of the principles of the invention, it will be understood that the invention may be embodied otherwise without departing from such principles.

What is claimed is:

1. An electric switch, comprising at least one fixed contact, a movable contact member having first and second arm portions disposed at angles to each other, at least one arm portion having a movable contact thereon movable with said contact member, an actuating member engageable with said movable contact member and being movable therealong over said second arm portion to engage said first arm portion and to pivot said first arm portion in a direction to move it toward said fixed contact, first spring means biasing said actuating member in a direction toward engagement with said movable contact member, said second arm portion being displaceable by movement of said first arm portion in a direction against the force of said first spring means to increase the biasing thereof, said actuating member comprising a lever having a first lever portion overlying said second arm portion and an upwardly extending second lever portion, a pushbutton engageable with said lever arm portion to move said lever along said movable contact member to pivot said first arm portion in a direction to move it toward said fixed contact to raise said second arm portion against said first lever arm portion, and a compression spring forming said first spring means defined between said pushbutton and said lever.

2. An electric switch according to claim 1, including at least one reset spring acting on said actuator.

3. An electric switch according to claim 2, wherein said actuator comprises a pushbutton and a separate actuator member supported on said pushbutton and being relatively displaceable in respect to said pushbutton between the two end positions.

4. An electric switch, comprising at least one fixed contact, a movable contact member having first and second arm portions disposed at angles to each other, at least one arm portion having a movable contact thereon movable with said contact member, an actuating member engageable with said movable contact member and being movable therealong over said second arm portion to engage said first arm portion and to pivot said first arm portion in a direction to move it toward said fixed contact, first spring means biasing said actuating member in a direction toward engagement with said movable contact member, said second arm portion being displaceable by movement of said first arm portion in a direction against the force of said first spring means to increase the biasing thereof, said actuating member comprising a lever having a straight portion overlying said second arm portion and an upwardly extending hook shaped portion, a pushbutton having a support stud over which said hook shaped portion is engaged and a compression spring forming said first spring means defined between said pushbutton and said lever.

5. An electric switch according to claim 4, including a bearing for said movable contact member for pivotally supporting said contact member located adjacent the juncture of said first and second arm portions.

6. A switch according to claim 4, wherein said actuating member comprises a ball member engageable on said second arm portion, said first spring means comprising a spring engageable against said ball to urge it into engagement with said second arm portion.

7. An electric switch according to claim 4, wherein said actuating member is displaceable parallel to said movable contact member second arm portion and bears thereon up to the engagement with said first arm portion.

8. An electric switch according to claim 4, wherein said first spring means acts on said actuating member along an axis extending transversely to the axis of said contact member second arm portion.

9. An electric switch according to claim 4, wherein said contact member comprises an angle member, support means pivotally supporting said angle member at the juncture of said first and second arm portions and a support member supporting said second arm portion in a non-actuated position.

10. An electric switch according to claim 4, wherein at least one of said arm portions is no longer than the other of said arm portions and is provided with switch contact means.

11. An electric switch according to claim 4, wherein said first arm portion is provided with first and second angle portions disposed at an angle to each other, said second angle portion being adjacent said second arm portion and forming an incline over which said contact member must move to compress said first spring means so as to provide an increased biasing force on said first arm portion to hold said fixed and movable contacts together.

12. An electric switch according to claim 4, wherein said first angle portion of said first arm portion defines a horizontal surface extending to said movable contact from said second angle portion along which said actuating member may be moved after said fixed and movable contacts are interengaged in the actuating direction of movement.

13. An electric switch according to claim 4, including second spring means biasing said actuating member in a direction against movement in an actuating direction.

14. An electric switch according to claim 4, wherein said first arm portion includes a bulge portion over which said actuating member must move upwardly to increase the biasing force of said first spring means.

15. An electric switch according to claim 4, wherein said second arm portion includes a downwardly extending bulge for forming a supporting portion for said contact member, said switch including a housing having a contact terminal over which said bulge is positioned.

16. An electric switch according to claim 4, wherein said second arm portion includes a downwardly extending tongue, said switch including a housing having a bottom wall supporting said movable contact member with a recess therein into which said tongue is engaged.

17. An electric switch according to claim 4, wherein said movable contact member includes a recess defined between said first and second arm portions, said lever including a portion at the juncture of said hook-shaped portion and said straight portion which engages over said recess.

18. An electric switch, comprising at least one fixed contact, a movable contact member having first and second arm portions disposed at angles to each other, at least one arm portion having a movable contact thereon movable with said contact member, an actuating member engageable with said movable contact member and being movable therealong over said second arm portion to engage said first arm portion and to pivot said first arm portion in a direction to move it toward said fixed contact, first spring means biasing said actuating member in a direction toward engagement with said movable contact member, said second arm portion being displaceable by movement of said first arm portion in a direction against the force of said first spring means to increase the biasing thereof, said actuating member comprising a lever having a straight portion resting on said second arm portion and an upstanding hook shaped portion with spaced apart legs, including a pushbutton having a support stud engaged within the hook shaped portion of said lever, the opposite ends of said hook shaped portion defining stops for said lever.

19. An electric switch, comprising at least one fixed contact, a movable contact member having first and second arm portions disposed at angles to each other, at least one arm portion having a movable contact thereon movable with said contact member, an actuating member engageable with said movable contact member and being movable therealong over said second arm portion to engage said first arm portion and to pivot said first arm portion in a direction to move it toward said fixed contact, first spring means biasing said actuating member in a direction toward engagement with said movable contact member, said second arm portion being displaceable by movement of said first arm portion in a direction against the force of said first spring means to increase the biasing thereof, said first arm portion including an inwardly extending bulge, said contact member comprising a lever having a straight portion overlying said first arm portion and a hook shaped portion extending upwardly therefrom away from said contact member, a curved front portion between said hook shaped portion and said first straight portion engageable with the upstanding portion of said contact member in an actuated position.

* * * * *